US006283773B1

(12) United States Patent
Price et al.

(10) Patent No.: US 6,283,773 B1
(45) Date of Patent: Sep. 4, 2001

(54) MEDIA JACK WITH EXTERNAL FUSE ACCESS

(75) Inventors: Tim Urry Price, Salt Lake City; John Evans, Riverton; Thomas A. Johnson, Draper, all of UT (US)

(73) Assignee: 3Com Corporation, Santa Clara, CA (US)

( * ) Notice: Subject to any disclaimer, the term of this patent is extended or adjusted under 35 U.S.C. 154(b) by 0 days.

(21) Appl. No.: 09/320,789

(22) Filed: May 27, 1999

(51) Int. Cl.[7] ..... H01R 13/60
(52) U.S. Cl. ..... 439/131
(58) Field of Search ..... 439/131, 621, 439/676, 946, 638, 344; 361/94, 115, 119, 102, 93, 56, 58; 174/48

(56) References Cited

U.S. PATENT DOCUMENTS 3,744,003 * 7/1973 Dipace ..... 439/621
3,851,226 * 11/1974 Chen ..... 174/48
5,086,216 * 2/1992 Mollet et al. ..... 439/621
5,309,625 5/1994 Onishi ..... 29/623
5,547,401 * 8/1996 Aldous et al. ..... 439/131
5,643,012 * 7/1997 Mai et al. ..... 439/622
5,777,836 * 11/1999 Price et al. ..... 361/94
5,980,322 * 11/1999 Madsen et al. ..... 439/621

* cited by examiner

*Primary Examiner*—Brian Sircus
*Assistant Examiner*—J. F. Duverne
(74) *Attorney, Agent, or Firm*—Workman, Nydegger & Seeley

(57) ABSTRACT

A jack for facilitating an electrical communication between a media plug and an electrical apparatus includes a low profile slide plate having an aperture extending therethrough. The aperture is configured to receive a media plug. A contact pin projects from the slide plate into alignment with the aperture and is configured to engage the media plug in electrical communication when the media plus is received within the aperture. Mounted on the slide plate is a pair of spaced apart first and second fuse contacts. The fuse contacts are configured to receive and retain a fuse disposed therebetween. The first fuse contact is disposed in electrical communication with the contact pin. The second fuse contact is configured for electrical coupling with the electrical apparatus. In one embodiment, the first and second fuse contacts are disposed within a fuse slot formed on the slide plate. The slide plate can be configured for either permanent or removable attachment to the electrical apparatus.

14 Claims, 3 Drawing Sheets

MEDIA JACK WITH EXTERNAL FUSE ACCESS

BACKGROUND OF THE INVENTION

1. The Field of the Invention

The present invention relates to electrical connectors for use with media plugs and, ore specifically, slidable jacks having an external fuse access wherein the jacks arc operable with PC cards and other electrical apparatus.

2. Present State of the Art

Electrical apparatus, such as personal computers, cellular telephones, and personal information managers (PIMs), are becoming increasingly dependent upon their ability to electrically communicate or share information with other electrical apparatus. To facilitate this electrical communication, a variety of different types of electrical couplers have been developed. An electrical coupler includes a plug and a corresponding jack or connector. The jack typically includes an aperture or socket configured to receive the plug so as to establish electrical communication therebetween.

Select types of electrical couplers have been designed for use with PC cards. A PC card is a small thin card typically having a standard size. A first type of connector is formed at one end of the PC card and is configured to couple with the electrical apparatus. A second type of connector or jack is formed at the opposing end of the PC card and is configured to couple with a desired outside line such as a telephone line or a network line. Disposed within the PC card is a circuit board providing the necessary circuitry to perform one or more intended functions. For example, in one type of PC card, the circuit board comprises a modem which enables the electrical apparatus to receive and transmit information over telephone lines. In another PC card, the circuit board enables the electrical apparatus to receive and transmit information with a network system over a network cable.

One conventional type of jack used for connecting a PC card to an exterior line comprises a thin plate which is slidably mounted to the PC card. The plate has a top surface with an aperture formed therein. A plurality of short contact pins are rigidly mounted to the thin plate. Each contact pin has a first end that is freely exposed within the aperture and an opposed second end mounted to the plate. A flexible wire ribbon has a first end that is soldered to the second end of the contact pins and an opposing second end that is soldered to contacts on the circuit board within the PC card.

The thin plate can selectively slide between an extended position and a retracted position. In the extended position, the aperture is exposed such that a corresponding plug, for example an RJ-11, commonly referred to as a telephone plug, can be received therein. The plug pushes against the contact pins so as to establish electrical contact therewith. As a result, electrical communication is established from the plug, through the contact pins and flexible wire ribbon, to the circuit board.

Mounted on the circuit board of most PC cards is a fuse. When a power surge, electric short or other irregular or non-standard voltage is applied to the circuit board through one of the connectors, the fuse is blow so as to protect the circuit board. The fuse also protects the electrical apparatus to which the current will subsequently flow. Although blowing of the fuse is effective in preventing further damage, it is also problematic. For example, PC cards are typically sealed closed during the manufacture process. As a result, once the fuse is blown, the PC card must either be returned to the factory for replacement of the fuse or the PC card is simply disposed of and replaced with a new PC card. Neither approach is very cost effective. Furthermore, blowing of the fuse deactivates the PC card and thus shuts down the operation thereof until the fuse is replaced.

fuses can also be mounted within the housing of other types of electrical apparatus such as personal computers, cellular telephones, and personal information managers.

OBJECTS AND BRIEF SUMMARY OF THE INVENTION

Accordingly, it is an object of the present invention to provide electrical apparatus wherein the fuse thereof is accessible by the consuming public for easy replacement.

Another object of the present invention is to provide electrical apparatus as above wherein the fuse can be replaced without the need for disassembling the electrical apparatus.

One specific object of the present invention is to provide PC cards wherein a replaceable fuse is mounted on the retractable jack thereof.

To achieve the foregoing objects, and in accordance with the invention as embodied and broadly described herein, a jack is provided to facilitate electrical communication between a media plug and an electrical apparatus, such as a PC card. The jack includes a low profile slide plate having an aperture extending therethrough. The aperture is configured to receive the media plug. A plurality of contact pin projects from the slide plate into alignment with the aperture. The contact pins are configured to engage the media plug in electrical communication when the media plus is received within the aperture.

The slide plate is configured for selective operation between an extended position and a retracted position. In the extended position, the aperture is openly exposed to receive the media plug. In the retraced position, the aperture is enclosed within the housing of the electrical apparatus.

Mounted on the slide plate is a pair of spaced apart first and second fuse contacts. The fuse contacts are configured to receive a fuse therebetween. In one embodiment, the fuse contacts can be disposed within a slot or notch formed on the slide plate. In an alternative embodiment, the fuse contacts can project from the surface of the slide plate.

The first fuse contact is disposed in electrical communication with a select one of the contact pins. The second fuse contact is configured for electrical coupling with the electrical apparatus. Accordingly when a fuse is disposed between the fuse contacts, electrical communication is facilitated between the select contact pin and the electrical apparatus.

The slide plate can be either fixedly or removably attached to the electrical apparatus. In the embodiment where the slide plate is fixedly attached to the electrical apparatus, the fuse contacts are preferably positioned so that the fuse can be accessed and replaced when the slide plate is in the extended position. In the embodiment where the slide plate is removably attached to the electrical apparatus, the fuse contacts can be positioned at any desired location on the slide plate.

Should the fuse on the slide plate blow due to an electrical short, power surge, or other anomaly, the unique configuration of the present invention allows the average consumer of the electrical apparatus to easily remove and replace the fuse. As a result, the electrical apparatus does not need to be disposed of or returned to the manufacturer for repairs. The ease in which the fuse can be replaced also minimizes any down time of the electrical apparatus.

These and other objects, features, and advantages of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1:
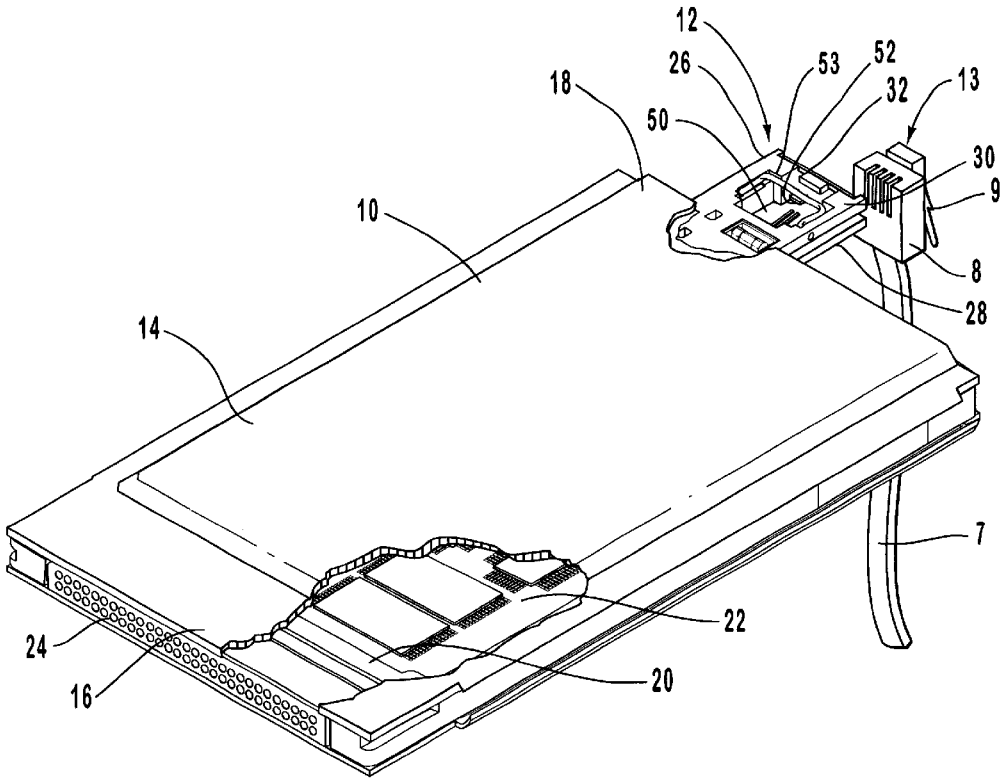
FIG. 1 is a perspective view of a PC card having one embodiment of an inventive jack slidably mounted thereon.

Depicted in FIG. 1 is a PC card 10 having mounted thereon a retractable jack 12 incorporating features of the present invention. As used in the specification and appended claims, the term "PC card" is broadly intended to include all types of cards which currently or may in the future fall under PCMCIA standards such as type I-IV cards. PC cards also include cards which fall outside of the PCMCIA standards but function in a similar manner. Examples of PC cards include network cards, modem cards, memory cards, and other cards which are adapted for assisting electrical apparatus to perform a specific function.

Retractable jack 12 is configured to both physically and electrically couple a media plug 13 to a desired electrical apparatus, such as depicted PC card 10. Media plug 13 is in electrical communication with an electrical cable 7 and includes a body 8 having a flexible prong 9 attached thereto. As used in the specification and appended claims, the term "media plug" is broadly intended to include RJ-type plugs such as the RJ-11, RJ-45, and other RJ types plugs which currently exist or will be developed in the future under new standards. The term "media plug" also includes those plugs having physical attributes that fall under F.C.C. Part 68, Subpart F. Although jack 12 is depicted as being mounted on PC card 10, it is also noted that jack 12 can be used with virtually any type of electrical apparatus that requires electrical coupling with a cable such as a telephone line or network line. Examples of such electrical apparatus include cellular telephones, pagers, personal information managers (PIM), PC cards, notebook computers, personal computers, diagnostic equipment, and other hand operated electrical devices.

PC card 10 is depicted as having a housing 14 extending from a front end 16 to an opposing back end 18. Housing 14 bounds a compartment 20 in which a circuit board 22 is disposed. Positioned at front end 16 is an electrical connector 24. One example of connector 24 is a 64-pin connector. Connector 24 is disposed in electrical communication with circuit board 22.

Figure 2:
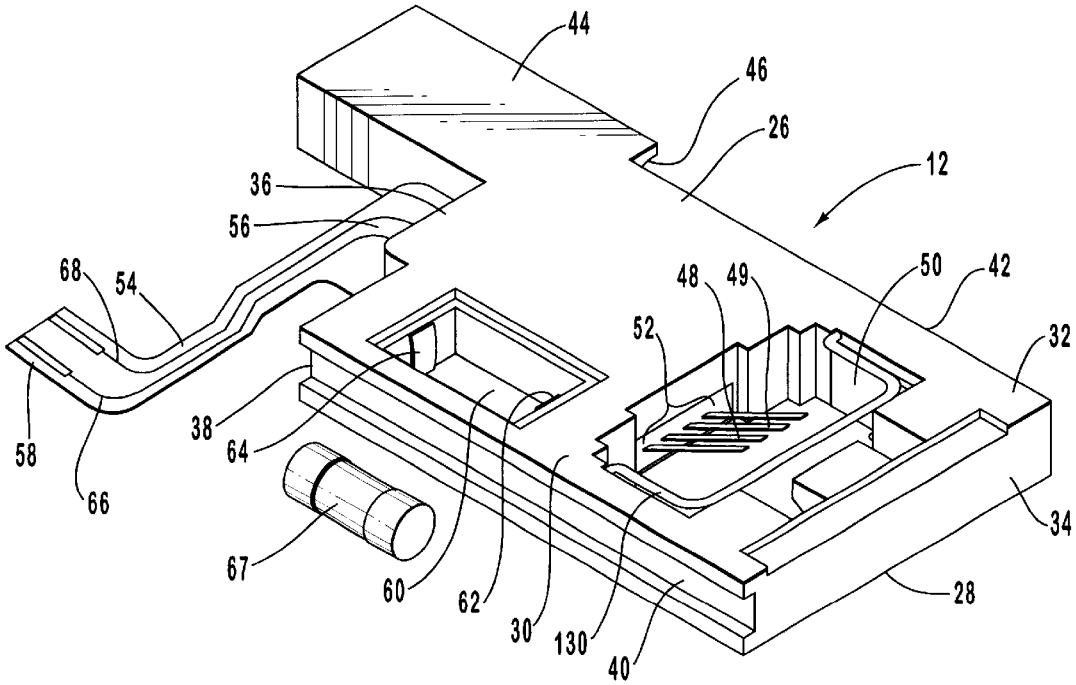
FIG. 2 is a perspective view of the inventive jack shown in FIG. 1.

Mounted at back end 18 of PC card 10 is jack 12. Jack 12 comprises a relatively thin slide plate 26 having a top surface 28 and an opposing bottom surface 30. As depicted in FIG. 2, top and bottom surfaces 28 and 30 longitudinally extend between a front end 32 where a front face 34 is formed and an opposing back end 36 where a back face 38 is formed. Top and bottom surfaces 28 and 30 also laterally extend between opposing side faces 40 and 42. Projecting from back end 36 of side plate 26 is an elongated retention arm 44. Retention arm 44 has a substantially C-shape transfers cross section that bounds a channel 46 longitudinally extending therethrough. Retention arm 44 is used for attaching slide plate 26 to PC card 10.

Extending between top surface 28 and opposing bottom surface 30 is an aperture 50. Aperture 50 is configured to receive at least a portion of media plug 13. Projecting from slide plate 26 into alignment with aperture 50 are a plurality of contact pins 52. Contact pins 52 are configured such that contact pins 52 are in electrical communication with media plug 13 when media plug 13 is received within aperture 50. Contact pins 52 include a first contact pin 48 and a second contact pin 49.

In one embodiment of the present invention, means are provided for releasable securing media plug 13 within aperture 50. By way of example and not by limitation, as depicted in FIG. 1, projecting into aperture 50 from front end 32 are a pair of spaced apart catch lips 52. Each catch lip 52 is configured to engage prong 9 on media plug 13 so as to mechanically retain media plug 13 with aperture 50. Alternative embodiments for the configuration of slide plate 26, the configuration and orientation of aperture 50, and alternative embodiments of the releasable securing means are disclosed in U.S. Pat. No. 5,547,401, filed Aug. 16, 1994 (hereinafter "the '401 patent'), and U.S. patent application Ser. No. 08/976,819, filed Nov. 24, 1997 (hereinafter "the '819 application"), which for purposes of disclosure are incorporated herein by specific reference.

Depicted in FIG. 2, the present invention also includes means for preventing the passage of media plug 13 completely through aperture 50. By way of example and not by limitation, rotatably extending between opposing sidewalls of aperture 116 is a substantially U-shaped saddle 130. Saddle 130 acts as a stop to prevent media plug 13 from passing too far through aperture 116 when media plug 13 is initially inserted from top surface 28. Examples of other embodiments of the means for preventing the passage of media plug 13 include an elastic member, ledge, or spring disposed below aperture 50. Examples of these and other embodiments of the means for preventing the passage of media plug 13 are disclosed in the '401 patent and '819 application which were previously incorporated herein by specific reference.

The present invention also includes means for effecting electrical communication between slide plate 26 and an electrical apparatus. By way of example and not by limitation, a flexible wire ribbon 54 has a first end 56 and an opposing second end 58. First and second line wires 66 and 68 longitudinally extend along wire ribbon 54. First end 56 of wire ribbon 54 is electrically coupled to slide plate 26.

Second end 58 of wire ribbon 54 is electrically coupled with circuit board 22 of PC card 10.

In the assembled configuration, slide plate 26 is mounted to PC card 10 such that slide plate 26 is selectively moveable between an extended and retracted position. In the retracted position, slide plate 26 is slid back within housing 14 such that aperture 50 is substantially enclosed therein. In the extended position, as depicted in FIG. 1, slide plate 26 is position such that aperture 50 is openly exposed to received media plug 13. Different embodiments for both electrically and mechanically attaching slide plate 26 to electrical apparatus, such as a PC card, arc disclosed in the '401 patent and '819 application which were previously incorporated herein by specific reference.

The present invention also includes means for housing a fuse on slide plate 26 such that first contact pin 48 is electrically coupled with a transfer line. The term "transfer line" as used in the specification and appended claims is broadly intended to include electrical wires, pins, contacts, and the like which can be used to facilitate electrical communication between slide plate 26 and an electrical apparatus. In the embodiment depicted in FIG. 2, the transfer line includes first line wire 66.

Figure 4:
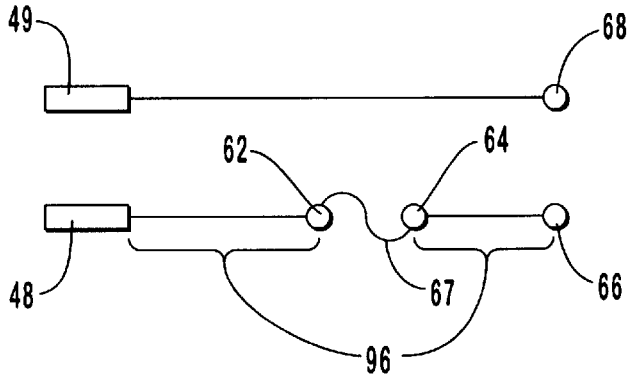
FIG. 4 is a schematic representation of the electrical layout of a jack shown in FIG. 3.

By way of example of the means for housing a fuse and not by limitation, disposed on bottom surface 30 of slide plate 26 is a fuse slot 60. Positioned at opposing ends of fuse slot 60 is a first fuse contact 62 and an opposing second fuse contact 64. As depicted in the schematic representation of FIG. 4, first contact pin 48 is in electrical communication with first fuse contact 62 while first line wire 66 is in electrical communication with second fuse contact 64. Second contact pin 49 is in direct electrical communication with second line wire 68. Depicted in FIG. 2, fuse slot 60 and contacts 62 and 64 are configured such that a fuse 67 can be received within slot 60 such that the opposing ends of fuse 67 bias against contacts 62 and 64, thereby facilitating electrical communication between first contact pin 48 and first line wire 66.

Fuse contacts 62 and 64 can be of any desired configuration that will effect electrical communication with the opposing ends of fuse 67. The type and configuration of fuse contacts 62 and 64 depends on the type of fuse 67 to be used. For example, fuse contacts 62 and 64 can comprises exposed wires, solder joints, prongs, sockets, clips, threaded shafts, or more conventional metal plate contacts. In one embodiment, fuse contacts 62 and 64 are configured so as to securely retain fuse 67 between fuse contacts 62 and 64. For example, at least one of fuse contacts 62 and 64 can be configured to produce a biasing force toward the opposing fuse contact. In this embodiment, the fuse contact can comprise a spring or bent plate which has resilient biasing properties. In yet other embodiments, fuse contact 62 and 64 can comprise C-shaped clamps or other clamping configurations for securely attaching to fuse 67.

Fuse 67 can comprise a variety of different fuses such as those commonly used on circuit boards for PC cards Examples of different types of fuses that can be used include surface mount fuses such as the MICRON GUARD™ MGA 125V quick-acting surface mount fuse available from Schurt; the NANOFUSE™, PICO™, and NONO$^{2}$™ subminiature surface mount fuses from Littlefuse; surface mount PTC 1812L series fuses from Littlefuse; and thin-film surface mount fuses such as 1206 SMF available from Littlefuse.

Figure 3:
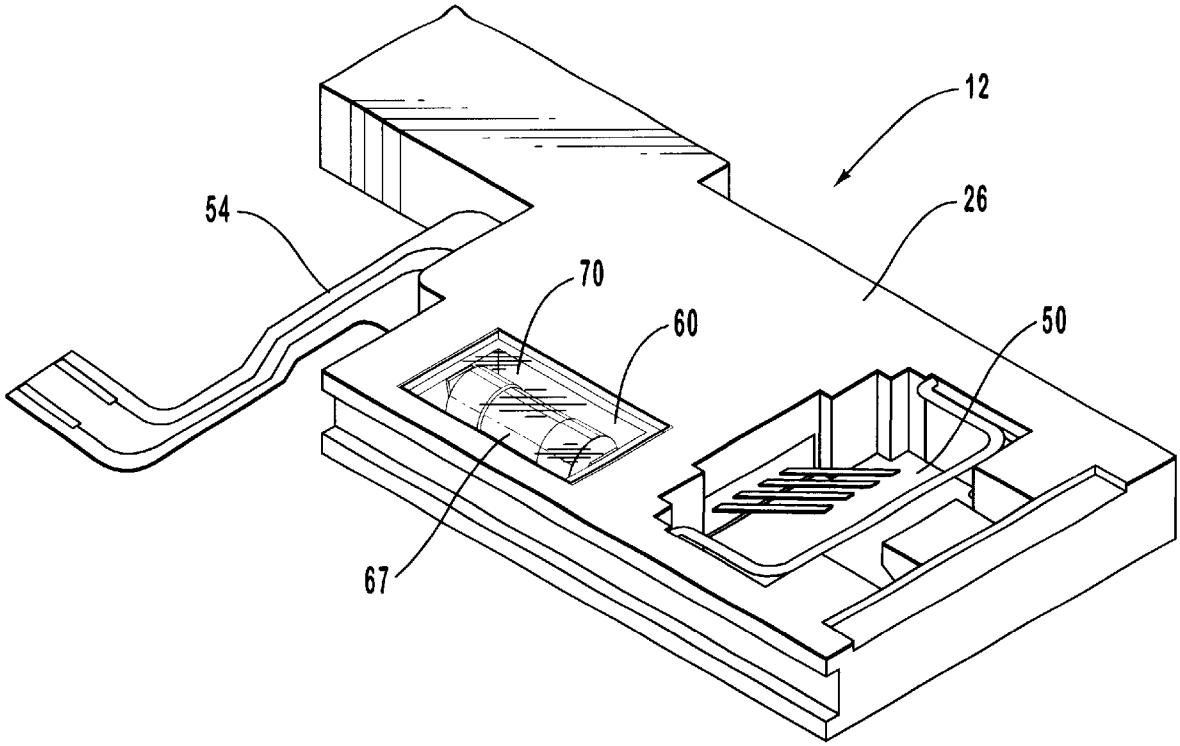
FIG. 3 is a perspective view of the jack shown in FIG. 2 having a protective shield covering a fuse mounted thereon.

Depicted in FIG. 3, means are provided for covering fuse slot 60. By way of example and not by limitation, a shield 70, such as made of paper or plastic, can be selectively secured over fuse slot 60 by an adhesive. In yet other alternative embodiments, the means for covering fuse slot 60 can comprise a hinged or other type of lid which enables selective opening of fuse slot 60.

During use, jack 12 is moved into the extended position so as to facilitate mechanical and electrical coupling with media plug 13. Should a power surge or other undesirable voltage be applied across fuse 67, fuse 67 will burn out so as to protect the other associated electrical equipment and lines. A knife or other corresponding tool can then be used to remove shield 70 or other cover. Fuse 67 is then removed and a new fuse 67 is inserted. Shield 70 is then reattached and the electrical apparatus is ready for continued use.

The present invention envisions that fuse slot 60 can be positioned at a variety of different locations on slide plate 26. By way of example and not by limitation, fuse slot 60 can be positioned at front end 32, on front face 34, and along either of side faces 40 or 42. Furthermore, fuse slot 60 can be exposed from either top surface 28 or bottom surface 30. In yet another embodiment, fuse slot 60 can extend completely through slide plate 26. In embodiments where jack 12 is configured to be permanently attached to the electrical apparatus, fuse slot 60 can be openly exposed when jack 12 is in the extended position. This enables easy replacement of fuse 67 without disassembling the electrical apparatus. In yet other embodiments, the electrical apparatus can be designed for easy partial disassembly to access fuse slot 66. In this embodiment, fuse 67 can be at least partially enclosed within the housing of the electrical apparatus.

Figure 5:
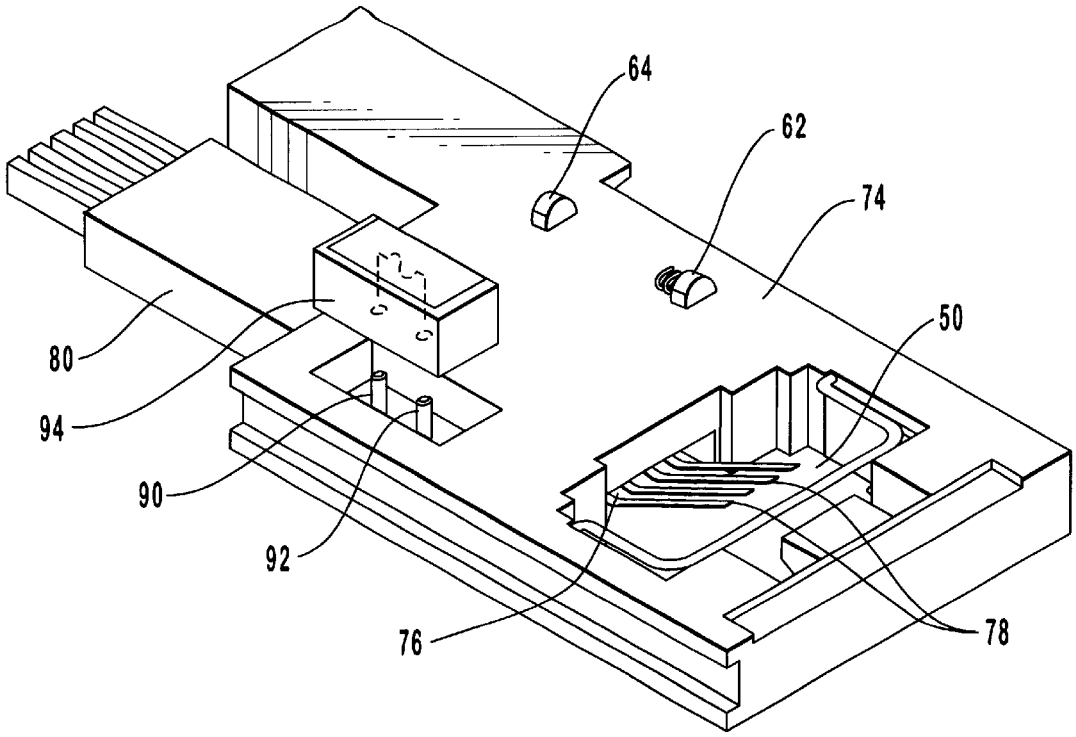
FIG. 5 is a perspective view of an alternative embodiment of an inventive jack which is removably attachable to an electrical apparatus.

In contrast to the use of fuse slot 60, the present invention also envisions alternative means for housing fuse 67 on slide plate 26. By way of example and not by limitation, as depicted in FIG. 5, fuse contacts 62 and 64 can be mounted so as to partially or fully project from the surface of slide pate 26. Again, fuse contacts 62 and 64 are spaced apart and configured to receive and retain fuse 67 therebetween. Projecting fuse contacts 62 and 64 can also be positioned at a variety of different locations on slide plate 26. FIG. 5 also depicts an embodiment which includes fuse contacts 90 and 92 each having a post configuration. Fuse contacts 90 and 92 are configured to receive a jumper fuse 94.

Figure 6:
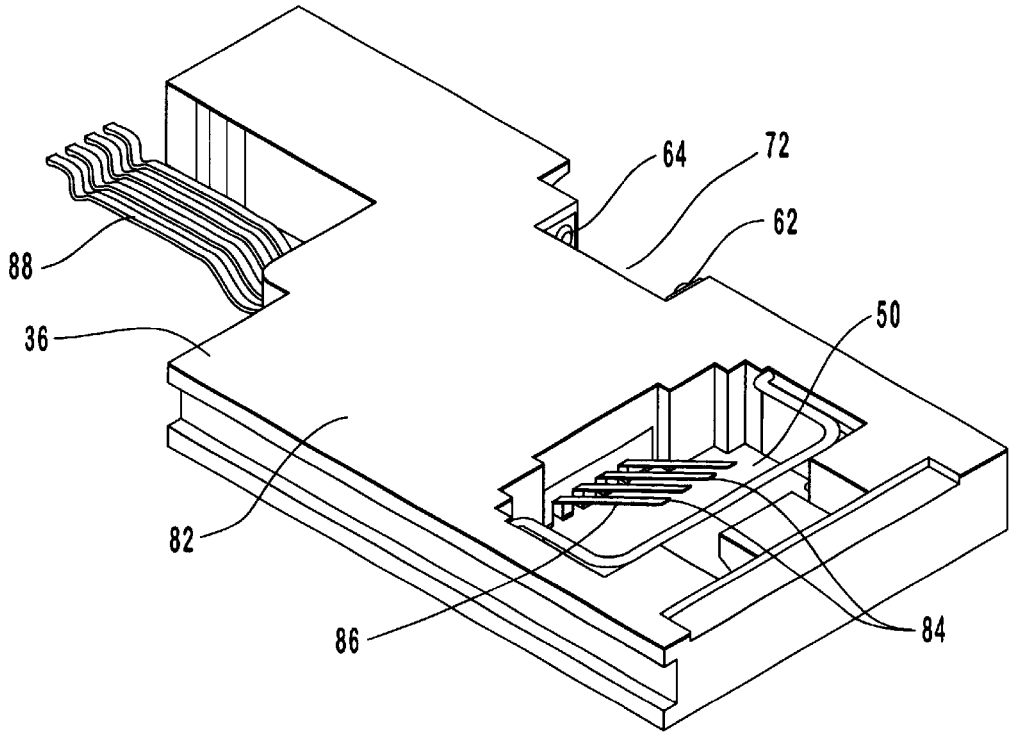
FIG. 6 is a perspective view of an alternative embodiment of an inventive jack which is removably attachable to an electrical apparatus.

In yet another alternative embodiment, as depicted in FIG. 6, fuse slot 60 can be replaced with a notch 72 having fuse contacts 62 and 64 mounted therein. Notch 72 can also be mounted at a variety of different locations on slide plate 26. In each of the above embodiments, covers can be positioned over the fuse disposed between fuse contacts 62 and 64.

In contrast to jacks or slide plates which are configured for permanent attachment with an electrical apparatus, the present invention also envision that fuses 67 can be mounted on jacks or slide plates which are selectively removable from the electrical apparatus. In these embodiments, it is not necessary that fuse 67 be accessible when slide plate 26 is in the extended position. Fuse 67 need only be accessible when slide plate 26 is separated from the electrical apparatus.

By way of example and not by limitation, depicted in FIG. 5 is an alternative embodiment of a slide plate 74 having a channel 76 longitudinally extending from aperture 50 to back end 36 thereof. Channel 76 is configured to receive a printed circuit board 80 having contact lines (not shown) thereon. Printed circuit board 80 is mounted on the electrical apparatus. Contact pins 78 project into aperture 50 and are configured to ride against the contact lines on printed circuit board 80 to effect electrical communication therewith. Since electrical communication between slide plate 74 and the electrical apparatus is facilitated by biased engagement between contact pins 78 and printed circuit board 80, as opposed to a fixed attachment, slide plate 74 can be removed and reattached to the electrical apparatus without damage thereto. One example of slide plate 74 which can be removably attached to an electrical apparatus is disclosed in U.S. patent application Ser. No. 09/271,620, filed Mar. 17, 1999 which for purposes of disclosure is incorporated herein by specific reference.

In yet another alternative embodiment, a slide plate 82 is depicted in FIG. 6 which can also be removably attached is an electrical apparatus. Slide plate 86 includes contact pins 84 which have a first end 86 projecting into aperture 50. Flexible engagement pins 88 project from back end 36 of slide plate. A corresponding electrical apparatus (not shown) is formed having electrical contact lines. Engagement pins 88 are configured to slide along in biased engagement against the contact lines so as to effect electrical communication between slide plate 82 and the electrical apparatus. Select engagement pins 88 can be directly connected with contact pins 84, such as in the form of an integral pin. Other engagement pins 88 can be connected through fuse contacts 62 and 64 to contact pins 84. Slide plate 82 can also be separated from the electrical apparatus without damage thereto. One embodiment of slide plate 82 is depicted in U.S. patent application Ser. No. 09/033,270, filed Mar. 2, 1998, which for purposes of disclosure is incorporated herein by specific reference.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A jack for facilitating electrical communication between a media plug and an electrical apparatus, the jack comprising:

(a) a slide plate having an aperture extending therethrough, the aperture being configured to receive the media plug;

(b) a contact pin projecting from the slide plate into alignment with the aperture, the contact pin being configured to engage the media plug when the media plug is received within the aperture;

(c) means for housing a separately removable fuse on the slide plate; and (d) a transfer line electrically coupling said contact pin with said electrical apparatus via said means for housing said fuse wherein at least a portion of said transfer line remains integral with said slide plate when said fuse is replaced within said means for housing said separately removable fuse.

2. A jack as recited in claim 1, wherein the means for housing comprises a fuse slot formed on the slide plate, the fuse slot being configured to receive an electrical fuse.

3. A jack as recited in claim 2, wherein the fuse slot is notched in along a side of the slide plate.

4. A jack as recited in claim 1, wherein the means for housing comprises a pair of spaced apart fuse contacts outwardly projecting from a surface of the slide plate, the fuse contacts being configured to receive and retain an electrical fuse therebetween.

5. A jack as recited in claim 1, wherein the transfer line comprises a flexible wire ribbon having a line wire formed thereon.

6. A jack as recited in claim 1, wherein the transfer line comprises a flexible engagement pin.

7. A jack as recited in claim 1, wherein the slide plate is configured to be removably attached to the electrical apparatus.

8. A jack for facilitating electrical communication between a media plug and an electrical apparatus, the jack comprising:

(a) a slide plate having an aperture extending therethrough, the aperture being configured to receive the media plug;

(b) a first fuse contact and a spaced apart second fuse contact integrally mounted on the slide plate, the first and second fuse contact being configured to receive a separately removable electrical fuse therebetween; and a contact pin projecting from the slide plate into alignment with the aperture, the contact pin being in electrical communication with the first fuse contact.

9. A jack as recited in claim 8, wherein at least one of the first and second fuse contacts are disposed within a slot formed on the slide plate, the slot being configured to receive the fuse.

10. A jack as recited in claim 8, wherein at least a portion of one of the first and second fuse contacts project from the surface of the slide plate.

11. A jack as recited in claim 8, wherein the first and second fuse contacts are configured to retain the fuse therebetween.

12. A jack as recited in claim 8, wherein one of the fuse contacts is configured to produce a biasing force against the fuse when the fuse is disposed between the first and second fuse contacts.

13. A jack as recited in claim 8, further comprising means for effecting electrical communication between the slide plate and the electrical apparatus.

14. A jack as recited in claim 8, wherein the slide plate is configured to be removably attached to the electrical apparatus.

* * * * *

UNITED STATES PATENT AND TRADEMARK OFFICE

CERTIFICATE OF CORRECTION

PATENT NO. : 6,283,773 B1 
DATED : September 4, 2001
INVENTOR(S) : Tim Urry Price, John Evans and Thomas A. Johnson It is certified that error appears in the above-identified patent and that said Letters Patent is hereby corrected as shown below:

Column 1,
Line 8, change “ore”, to -- or --
Line 9, change “arc” to -- are --
Line 60, change “blow” to -- blown --

Column 2,
Line 5, change “fuses” to -- Fuses --
Line 27, change “pin” to -- pins --
Line 28, change “project” to -- projects --

Column 4,
Line 17, change “transfers” to -- transfer --
Line 31, change “releasable” to -- releasably --

Column 5,
Line 12, change “arc” to -- are --
Line 56, after “cards”, insert a period Column 6,
Line 2, change “other” to -- another --
Line 3, change “embodiments” to -- embodiment --
Line 52, change “envision” to -- envisions --

Signed and Sealed this

Fourth Day of June, 2002

*Attest:*

*Attesting Officer*

JAMES E. ROGAN
*Director of the United States Patent and Trademark Office*